US010129653B2

(12) United States Patent
Kang et al.

(10) Patent No.: US 10,129,653 B2
(45) Date of Patent: Nov. 13, 2018

(54) SPEAKER APPARATUS

(71) Applicant: SAMSUNG ELECTRONICS CO., LTD., Suwon-si (KR)

(72) Inventors: Seung Won Kang, Suwon-si (KR); Eui Han Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 217 days.

(21) Appl. No.: 15/068,039

(22) Filed: Mar. 11, 2016

(65) Prior Publication Data

US 2016/0269829 A1 Sep. 15, 2016

(30) Foreign Application Priority Data

Mar. 13, 2015 (KR) ..... 10-2015-0034758

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2209/022* (2013.01); *H04R 2209/024* (2013.01); *H04R 2400/07* (2013.01); *H04R 2400/11* (2013.01)

(58) Field of Classification Search
CPC ..... H04R 9/025; H04R 9/06; H04R 2400/11; H04R 2209/024; H04R 2209/022; H04R 2400/07
USPC ..... 381/400, 412, 414, 419
See application file for complete search history.

(56) References Cited

U.S. PATENT DOCUMENTS 4,933,975 A * 6/1990 Button ..... H04R 9/022 381/397
6,111,969 A * 8/2000 Babb ..... H04R 9/063 381/396
6,175,637 B1 * 1/2001 Fujihira ..... H04R 9/025 381/401
6,639,994 B1 * 10/2003 Proni ..... H04R 3/002 381/406
6,829,366 B2 * 12/2004 Tanabe ..... H04R 9/06 381/397

(Continued)

FOREIGN PATENT DOCUMENTS

DE 9113037 U1 1/1992
EP 1418792 A2 5/2004

(Continued)

OTHER PUBLICATIONS

Communication dated Aug. 29, 2017, from the European Patent Office in counterpart European Application No. 16159728.1.

(Continued)

*Primary Examiner* — Oyesola C Ojo
(74) *Attorney, Agent, or Firm* — Sughrue Mion, PLLC

(57) ABSTRACT

A speaker apparatus capable of operating in a large amplitude regime by minimizing magnetic loss, is provided. The speaker device includes a magnet configured to generate a magnetic flux, a pole piece configured to form a path of the magnetic flux generated by the magnet, a back plate provided at a lower end of the pole piece to support the magnet, and a plate provided to form a magnetic gap between the plate and the pole piece. Several plates may be provided so that the magnetic gap is expanded to enlarge amplitude of output sound.

16 Claims, 10 Drawing Sheets

(56) References Cited

U.S. PATENT DOCUMENTS

| | | | | |
|---|---|---|---|---|
| 6,996,247 | B2 * | 2/2006 | Stiles | H04R 9/025 381/412 |
| 8,155,373 | B2 * | 4/2012 | Kosuda | H04R 9/025 381/396 |
| 8,249,292 | B1 * | 8/2012 | James | H04R 9/06 381/412 |
| 8,781,150 | B2 * | 7/2014 | Babb | H04R 9/022 381/397 |
| 2001/0033673 | A1 * | 10/2001 | Babb | H04R 9/04 381/401 |
| 2003/0152246 | A1 | 8/2003 | Tanabe | |
| 2004/0131223 | A1 * | 7/2004 | Stiles | H04R 9/025 381/412 |
| 2005/0047626 | A1 * | 3/2005 | Barnes | H04R 9/025 381/412 |
| 2005/0190946 | A1 * | 9/2005 | Stiles | H04R 9/025 381/421 |
| 2006/0251286 | A1 | 11/2006 | Stiles | |
| 2011/0069857 | A1 | 3/2011 | Miller et al. | |
| 2011/0211725 | A1 | 9/2011 | Takewa et al. | |
| 2012/0207339 | A1 * | 8/2012 | Babb | H04R 9/022 381/400 |
| 2015/0117698 | A1 * | 4/2015 | Bullimore | H04R 7/16 381/398 |

FOREIGN PATENT DOCUMENTS

| | | | |
|---|---|---|---|
| EP | 1448018 | A2 | 8/2004 |
| EP | 1448018 | A3 | 8/2004 |
| EP | 1919253 | A1 | 5/2008 |
| EP | 2487933 | A1 | 8/2012 |
| JP | H 6-197399 | A | 7/1994 |

OTHER PUBLICATIONS

Communication dated Aug. 12, 2016, issued by the European Patent Office in counterpart European Patent Application No. 16159728.1.

* cited by examiner

SPEAKER APPARATUS

CROSS-REFERENCE TO RELATED APPLICATION

This application claims priority from Korean Patent Application No. 10-2015-0034758, filed on Mar. 13, 2015 in the Korean Intellectual Property Office, the disclosure of which is incorporated herein by reference in its entirety.

BACKGROUND

1. Field

Apparatuses consistent with exemplary embodiments of the present disclosure relate to a speaker apparatus capable of operating in a large amplitude regime by minimizing magnetic loss.

2. Discussion of the Related Art

A speaker is a sound system which converts an electrical signal output from an audio amplifier into a vibration of a vibration unit to generate a wave of condensation and rarefaction in air to emit a sound wave; there are many types of speakers including a magnetic type, a dynamic type, a condenser type, a piezo-electric type, and a ceramic type, etc.

Generally, a speaker includes a magnet generating a magnetic flux, a yoke unit providing a path of the magnetic flux, a magnetic circuit unit including a bobbin around which a voice coil is wound, a frame, a diaphragm vibrating according to a movement of the bobbin, a damper adjusting a vibration direction of the diaphragm, and a vibration system including an edge which fixes an outside edge of the diaphragm to the frame.

Therefore, when a current is applied to the voice coil, the magnetized voice coil interacts with a magnetic flux generated by a magnet and moves in the front-back direction, and thereby the diaphragm vibrates to generate a sound pressure.

Recently, thinness and slimness is being required of speakers in keeping with the trends for electronic devices.

Meanwhile, the thinness and the slimness requirements impose size limits on the vibration system of the speaker, and therefore a restriction on amplitude may result.

Due to this restricted amplitude, a speaker force factor (BL) is relatively degraded compared to that of a speaker of the same output, and therefore sound quality may be degraded.

SUMMARY

Therefore, it is an aspect of the present disclosure to provide a speaker apparatus capable of an operation in a large amplitude regime.

It is another aspect of the present disclosure to provide a speaker apparatus capable of minimizing a magnetic loss by the ability to operate in a large amplitude regime.

It is still another aspect of the present disclosure to provide a speaker apparatus capable of obtaining a plentiful sound output by the ability to operate in a large amplitude regime even when the speaker apparatus is fabricated in a small size.

Additional aspects of the disclosure will be set forth in part in the description which follows and, in part, will be obvious from the description, or may be learned by practice of the disclosure.

According to an aspect of the present disclosure, a speaker apparatus includes a magnet configured to generate a magnetic flux, a pole piece configured to form a path of the magnetic flux generated by the magnet, a back plate provided at a lower end of the pole piece to support the magnet, and at least one plate provided such that a magnetic gap is formed between the at least one plate and the pole piece. The at least one plate is provided so that the magnetic gap is expanded to enlarge amplitude of output sound.

Further, the magnet may include neodymium.

Further, the at least one plate may include a top plate disposed on an upper side of the magnet, and at least one bumper plate disposed between the magnet and the back plate.

Further, the at least one bumper plate is adhered by an adhesive member.

Further, the speaker apparatus may further include a voice coil disposed in the magnetic gap and provided to vibrate when a current is applied, and a diaphragm configured to generate a sound pressure based on a vibration of the voice coil.

Further, the at least one bumper plate may have one of from among a quadrangle shape, a pentagon shape, a cone shape, a ring shape, and a diamond shape.

According to another aspect of the present disclosure, a speaker apparatus includes a frame, a pole piece coupled to the frame, a magnet provided at in the pole piece and configured to generate a magnetic flux, a top plate disposed on an upper side of the magnet, a voice coil disposed in a magnetic gap and provided to vibrate when a current is applied, a vibration plate configured to generate a sound pressure based on a vibration of the voice coil, a back plate provided at a lower end of the pole piece, and at least one bumper plate disposed between the back plate and the magnet.

Further, the magnet may include neodymium.

Further, the at least one bumper plate may have one from among a quadrangle shape, a pentagon shape, a cone shape, a ring shape, and a diamond shape.

Further, an adhesive may be provided on an upper surface and a lower surface of the at least one bumper plate.

Further, the at least one bumper plate may be disposed on the back plate.

Further, the frame may have a cone shape in which a diameter increases from the downward direction to the upward direction.

Further, the back plate may support the magnet.

Further, the magnetic gap may be formed between the top plate and the pole piece.

Further, the at least one bumper plate may be provided such that the magnetic gap is expanded to enlarge an amplitude of the voice coil.

Further, the top plate and the back plate may have corresponding sizes.

BRIEF DESCRIPTION OF THE DRAWINGS

These and/or other aspects of the disclosure will become apparent and more readily appreciated from the following description of the exemplary embodiments, taken in conjunction with the accompanying drawings of which.

DETAILED DESCRIPTION

Hereinafter, exemplary embodiments of the present disclosure will be described in detail with reference to the attached drawings. Meanwhile, the terms such as "front end", "rear end", "upper portion", "lower portion", "upper end", and "lower end" used in the following descriptions are defined on the basis of drawings, and a shape and a position of each element should not be limited by the terminology.

FIGS. 1 to 4 are diagrams illustrating a speaker apparatus with a bumper plate installed according to an exemplary embodiment of the present disclosure.

Figure 1:
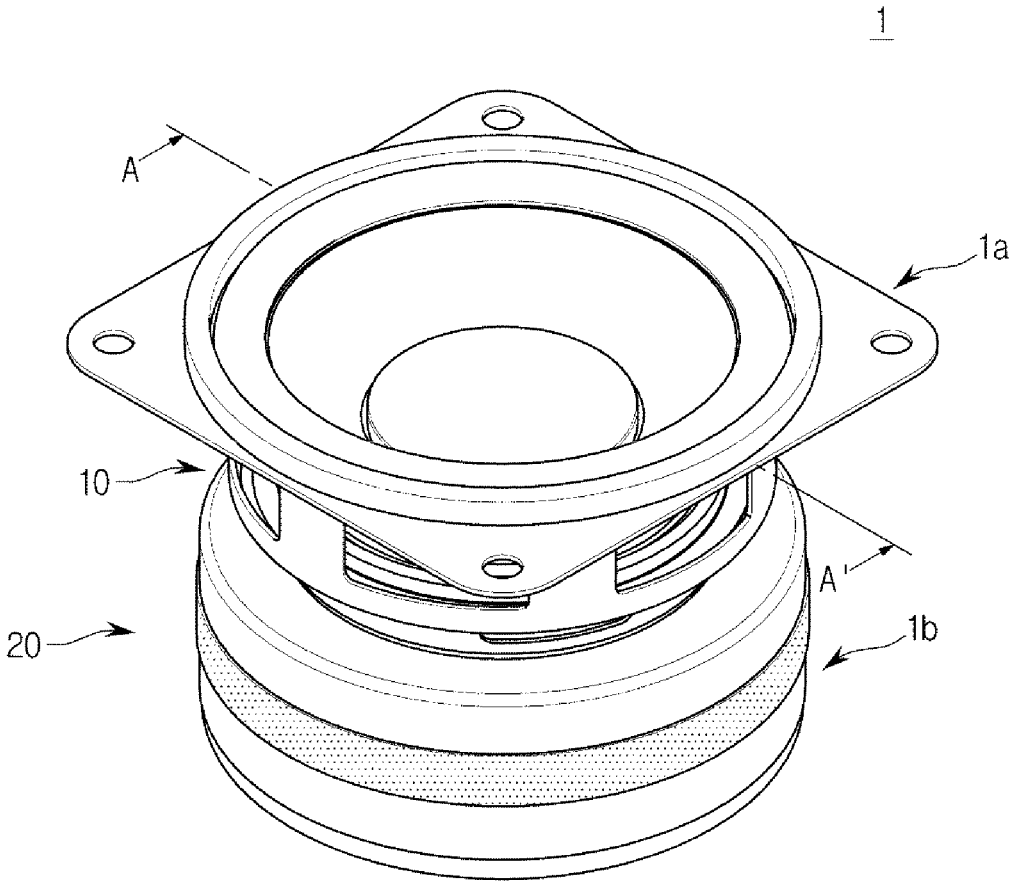
FIG. 1 is a perspective view illustrating a speaker apparatus according to an exemplary embodiment of the present disclosure.
Figure 2:
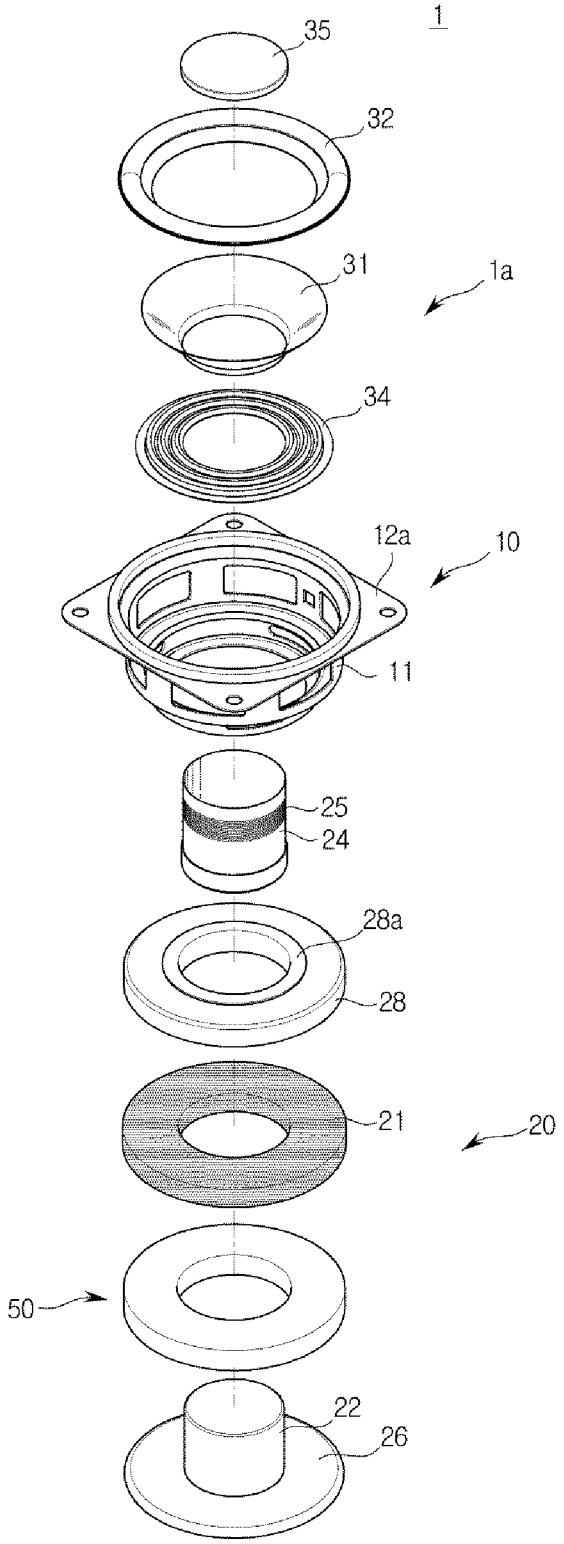
FIG. 2 is an exploded perspective view illustrating the speaker apparatus according to the exemplary embodiment of the present disclosure.
Figure 3:
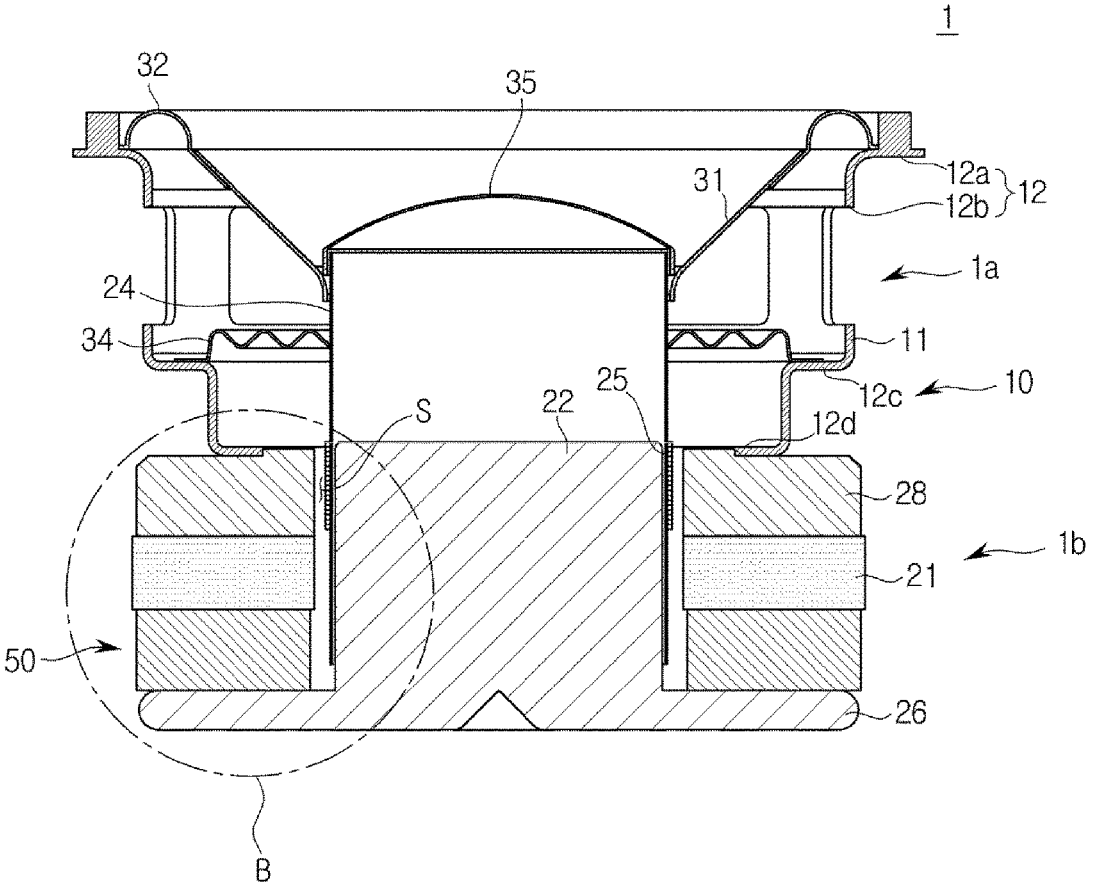
FIG. 3 is a cross-sectional view taken along line A-A' of FIG. 1.
Figure 4:
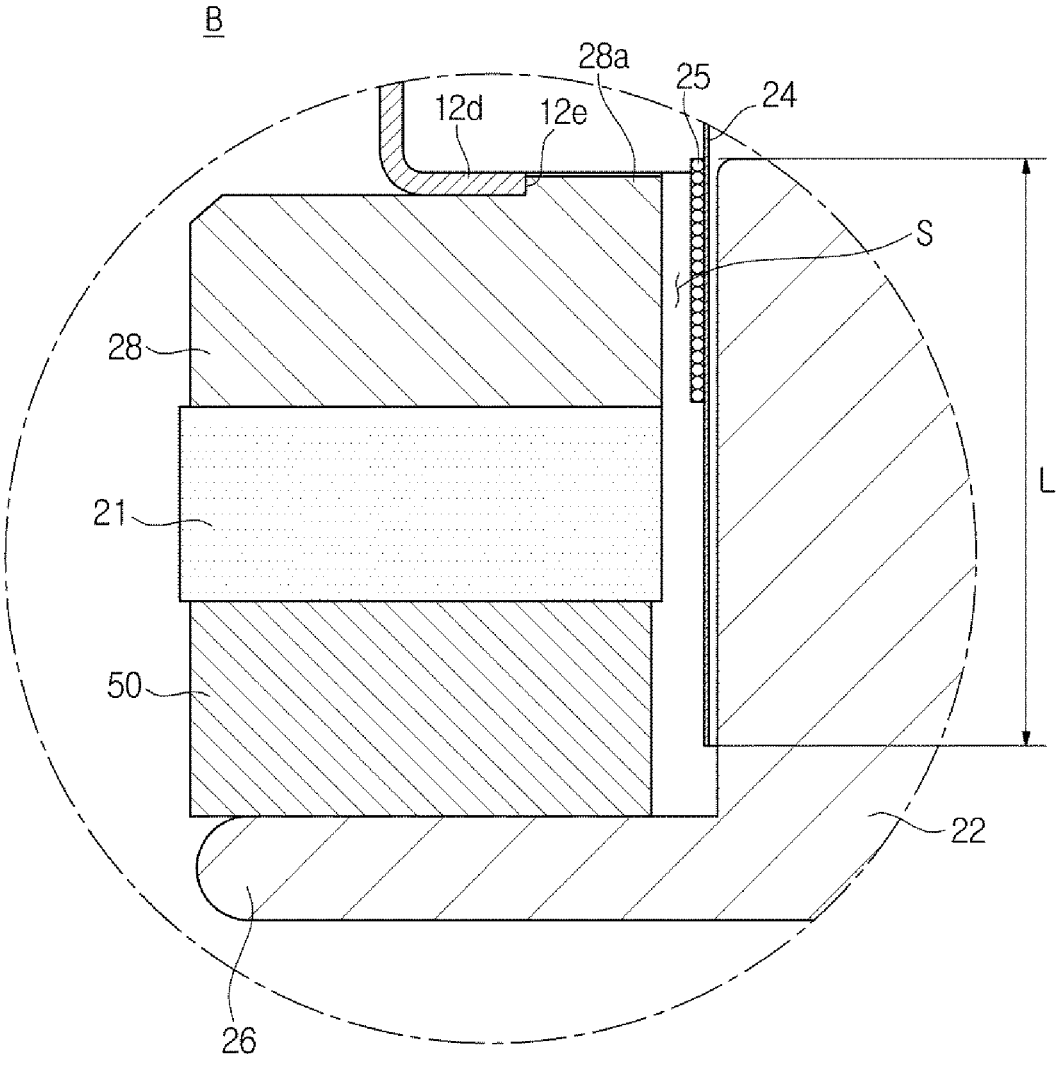
FIG. 4 is an enlarged view illustrating a portion B of FIG. 3.

As shown in FIGS. 1 and 2, the speaker apparatus 1 may include a hollow frame 10, a vibration system 1*a* provided in the frame 10, and a magnetic circuit unit 1*b*.

The magnetic circuit unit 1*b* may include a magnet 21 generating a magnetic flux, and a yoke unit 20 forming a path of the magnetic flux generated by the magnet 21.

The vibration system 1*a* may include a voice coil 25 magnetized when a current is applied and moving by an interaction with the magnetic flux generated by the magnet 21, a bobbin 24 provided such that the voice coil is wound around the bobbin 24, a vibration plate 31 vibrating based on a vibration of the voice coil 25 and generating a sound, a damper 34 guiding a movement direction of the voice coil 25 to forward-backward direction and restricting a movement of a left-right direction, an edge unit 32 coupling an outer side edge of the vibration plate 31 to the frame 10, and a dust cap 35 preventing a penetration of a foreign substance into an inside of the frame 10.

The frame 10 forms an external appearance of the speaker apparatus 1, and may include a body 11 formed as a hollow cylinder in the center thereof.

The body 11 of the frame 10 may include a first flange 12*a* formed on an upper end portion thereof, a second flange 12*b* formed separated from the first flange 12*a* by a predetermined distance in the downward direction, a third flange 12*c* formed separated from the second flange 12*b* by a predetermined distance in the downward direction, and a fourth flange 12*d* formed separated from the third flange 12*c* in the downward direction and formed in an inside direction on a lower end portion of the body 11.

Therefore, an external appearance of the frame 10 may have a cone shape in which a diameter increases from the downward direction to the upward direction. Here, the frame 10 may be formed in a shape corresponding to a shape of the vibration plate 31, or it is preferable that the frame 10 is formed to have a shape larger than that of the vibration plate 31 to encircle the outside of the vibration plate 31.

An example in which the frame 10 of the exemplary embodiment is formed to have a diameter of an upper side larger than a diameter of a lower side is shown, but the inventive concept of the present disclosure is not limited thereto. For example, the frame may also include one of a cylinder shape, a plane shape, and an oval shape.

The magnetic circuit unit 1*b* may be disposed on a lower side of the frame 10 of the speaker apparatus 1, and the vibration system 1*a* may be disposed on an upper side of an inside of the frame 10.

The vibration system 1*a* may include the voice coil 25 provided to vibrate in association with the magnetic circuit unit 1*b*, the bobbin 24 around which the voice coil 25 is wound, the vibration plate 31 vibrated by the voice coil 25 and reproducing a sound, an edge unit 32 making a connection between the vibration plate 31 and the frame 10, a damper 34 guiding a movement of the voice coil 25 to the forward-backward direction and restricting a movement in the left-right direction, and a dust cap 35 coupled to the bobbin 24.

The dust cap 35 is mounted on an upper side end portion of the bobbin 24. The dust cap 35 is provided to prevent a penetration of foreign substances into the inside of the vibration system 1*a* including bobbin 24, the voice coil 25, etc.

The dust cap 35 may be fixed by an adhesive to the inside center of the vibration plate 31.

The voice coil 25 is magnetized when a current is applied and moves by an interaction with the magnetic flux generated by the magnet 21 which will be described below.

The vibration plate 31 serves to externally transfer the sound by changing vibration according to the sound.

An example in which the vibration plate 31 of the exemplary embodiment has a cone shape in which a lower side of a middle portion is convex, is shown, but the inventive concept of the present disclosure is not limited thereto. For example, the vibration plate 31 may include one of a cylinder shape, a plane shape, and an oval shape.

The vibration plate 31 is a core element which determines sound quality, tone, and frequency characteristics of the speaker apparatus 1 and may be formed to have different sound characteristics based on quality of material, mass, and structure thereof.

Meanwhile, the magnetic circuit unit 1*b* is a portion in which an electrical signal is transferred to generate a sound in the speaker apparatus 1. The magnetic circuit unit 1*b* may include the magnet 21 generating a magnetic flux and the yoke unit 20 forming a path of the magnetic flux generated by the magnet 21.

The magnet 21 of the magnetic circuit unit 1*b* may include a plurality of poles including one N pole and one S pole and may be magnetized in a direction from front to rear. Hereinafter, the front direction is a direction in which a sound wave propagates in the speaker apparatus 1 and refers to an upper side of FIG. 1, and the rear direction is a direction opposite thereof and refers to a lower side of FIG. 1.

The magnet 21 may have a hollow ring shape.

Here, the magnet 21 may be formed to have a predetermined thickness, and it is preferable that the magnet 21 is formed flat to be stacked on the upper side and the lower side.

The magnet 21 may be formed to have various thicknesses according to a design based on an output of the speaker apparatus 1. The magnet 21 includes neodymium. An example in which the magnet 21 of the embodiment includes neodymium is shown, but the inventive concept of the present disclosure is not limited thereto. For example, the magnet 21 may also be formed including a ferrite or other permanent magnet material.

Further, an example in which the magnet 21 of the exemplary embodiment is formed to have a ring shape is shown, but the inventive concept of the present disclosure is not limited thereto. For example, the magnet 21 may include one of a plane shape, a quadrangle shape, and an oval shape.

Meanwhile, the yoke unit 20 may include a pole piece 22 having a cylinder shape, a back plate 26 provided at a lower end of the pole piece 22, a top plate 28 provided on an upper side of the pole piece 22, and a bumper plate 50 provided between the back plate 26 and the magnet 21.

The pole piece 22 is disposed in the center of the magnet 21. The back plate 26, the top plate 28, and the bumper plate 50 may be formed including a magnetic material having a low magnetic resistance including steel, an alloy, or other magnetic materials.

The back plate 26, the top plate 28, and the bumper plate 50 may be coupled through an adhesive member, or mutually coupled through a clamping member including a screw, etc.

The back plate 26 may be provided to be connected to a lower end of the pole piece 22. The pole piece 22 may be formed to be protruded toward the front (upward) in a middle portion of the back plate 26.

Here, the pole piece 22 may be formed as one body with the back plate 26. The pole piece 22 may be formed by forging the back plate 26. That is, the shape of the pole piece 22 whose middle portion is protruded upward is formed using a mechanical method in which an edge of a plate material of a plane shape is pounded with a hammer, etc. or is pressurized, and the shape of the back plate 26 is formed in the edge.

Meanwhile, in the embodiment of the present disclosure, an example in which the back plate 26 and the pole piece 22 are formed as one body is shown, but the inventive concept of the present disclosure is not limited thereto. For example, the back plate 26 and the pole piece 22 may each be formed independently and then configured to be combined.

The pole piece 22 may be provided to form a path of the magnetic flux generated by the magnet 21.

The top plate 28 may be disposed toward the front of the magnet 21, that is, may be in the upward direction. The top plate 28 may roughly have a ring shape with a hollow in the middle, and the pole piece 22 may be inserted in the hollow of the top plate 28.

Here, a fixing bump 28*a* for coupling with the frame 10 may be formed on a top surface of the top plate 28. The fixing bump 28*a* may be protruded in a circumferential direction in the center of the top surface.

The fixing bump 28*a* of the top plate 28 may be inserted and fixed in the fourth flange 12*d* of the frame 10. Meanwhile, in the exemplary embodiment of the present disclosure, an example in which the fixing bump 28*a* is formed in the top plate 28 so that the top plate 28 is fixed to the frame 10 is shown, but the inventive concept of the present disclosure is not limited thereto.

The top plate 28 may be formed in a ring shape having a predetermined thickness, and it is preferable that the top plate 28 is formed flat to be stackable on the upper portion and the lower portion.

A magnetic gap S generating a magnetic force may be formed between the top plate 28 and the pole piece 22.

The top plate 28 and the back plate 26 are respectively disposed on an upper side and a lower side of the magnet 21 and provided to support the magnet 21, and it is preferable that the top plate 28 and the back plate 26 are formed with corresponding sizes and shapes.

Meanwhile, a bumper plate 50 may be provided between the back plate 26 and the magnet 21.

The bumper plate 50 may roughly have a ring shape with a hollow, and the pole piece 22 may be inserted in the hollow of the bumper plate 50. The bumper plate 50 may be formed to have a predetermined thickness and may be formed flat to be stackable on an upper side and a lower side.

The top plate 28, the magnet 21, the bumper plate 50, and the back plate 26 are sequentially stacked and disposed from an upper end of the pole piece 22.

The bumper plate 50 may include at least one bumper plate.

Meanwhile, the thickness of the bumper plate 50 may be set variously according to a design of a designer based on an output of the speaker apparatus 1. Here, the thickness of the bumper plate 50 may make the magnetic gap S expandable and enlarge the amplitude of the voice coil 25. Further, the top plate 28, the magnet 21, the bumper plate 50, and the back plate 26 may be mutually coupled by an adhesive member.

With these structures, the yoke unit 20 includes lines of magnetic force starting from the N pole of the magnet 21 to end up at the S pole of the magnet 21 through the top plate 28, the pole piece 22, the magnetic gap S formed by an applied electrical signal, and the back plate 26.

Meanwhile, the magnetic gap S may be expanded by the bumper plate 50, and a movable distance of the vibrating voice coil 25 wound around the bobbin 24 may be increased by the expanded magnetic gap S.

That is, the movable distance required for the voice coil 25 to vibrate may be increased by the magnetic gap S enlarged by the thickness of the bumper plate 50 formed between the back plate 26 and the magnet 21, relative to a conventional magnetic gap formed by a top plate and a back plate.

Meanwhile, the movable distance L of the voice coil 25 may be variously changed according to a design of a designer based on an output of the speaker apparatus 1. However, in the exemplary embodiments, it is preferable that the movable distance L is formed to be the same as or greater than the entire thickness of the top plate 28, the magnet 21, and the bumper plate 50. The enlargement of the movable distance L of the voice coil 25 may enlarge the amplitude of output sound and maximize a low frequency component and therefore a plentiful sound quality may be formed.

Meanwhile, the voice coil 25 may be properly designed to interact with a magnetic flux of an inside of the magnetic gap S.

The enlargement of the movable distance of the voice coil may result in a large amplitude and may minimize magnetic loss.

Figure 5:
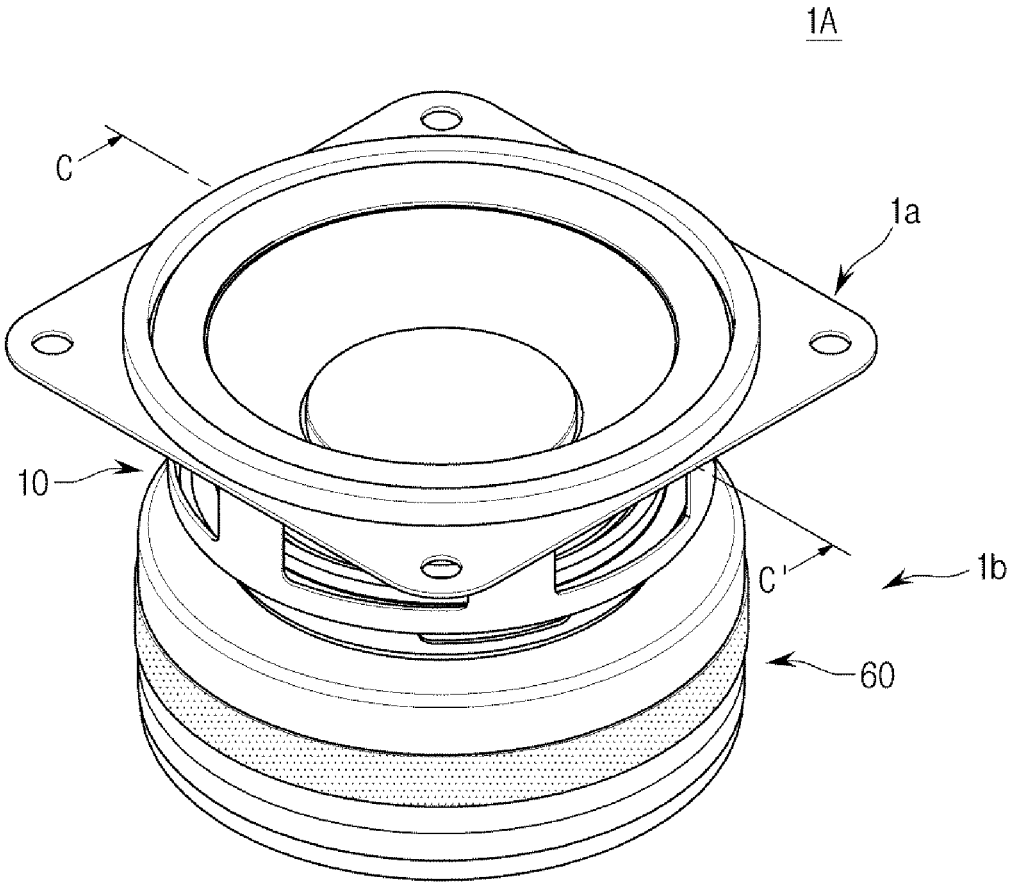
FIG. 5 is a perspective view illustrating a speaker apparatus according to another embodiment of the present disclosure.
Figure 6:
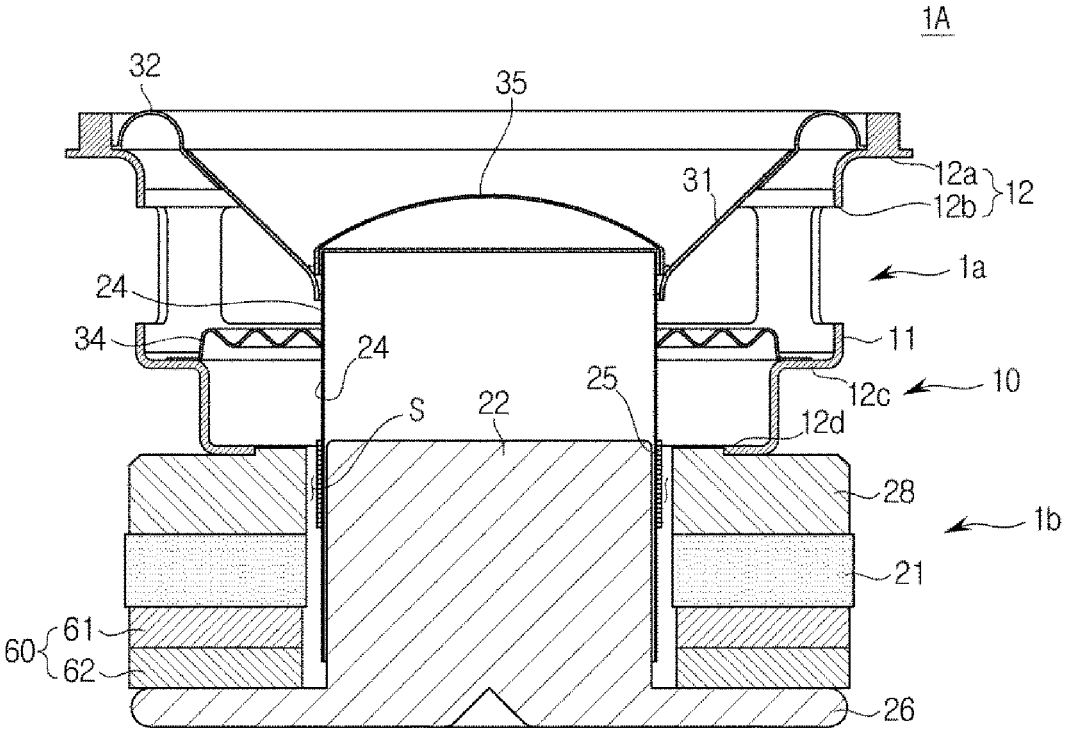
FIG. 6 is a cross-sectional view taken along line C-C' of FIG. 5.

FIGS. 5 and 6 are diagrams illustrating a speaker apparatus in which a bumper plate is installed according to another exemplary embodiment of the present disclosure.

As shown in FIGS. 5 and 6, the speaker apparatus 1A includes a hollow frame 10, a vibration system 1*a* provided in the frame 10, and a magnetic circuit unit 1*b*.

The magnetic circuit unit 1*b* may include a magnet 21 generating a magnetic flux and a yoke unit 20 forming a path of the magnetic flux generated by the magnet 21.

The magnet 21 of the magnetic circuit unit 1*b* may include a plurality of poles including one N pole and one S pole and may be magnetized in a direction from a front to rear. Hereinafter, the front direction is a direction in which a sound wave propagates in the speaker apparatus 1 and refers to an upper side of FIG. 5, and the rear direction is a direction opposite thereof and refers to a lower side of FIG. 5.

The magnet 21 may include neodymium. An example in which the magnet 21 of the exemplary embodiment includes neodymium is shown, but the inventive concept of the present disclosure is not limited thereto. For example, the magnet 21 may also be formed including a ferrite or other permanent magnet materials.

Meanwhile, the yoke unit 20 includes a pole piece 22 having a cylinder shape, a back plate 26 provided at a lower end of the pole piece 22, a top plate 28 provided on an upper side of the pole piece 22, and a bumper plate 60 provided between the back plate 26 and the magnet 21.

The pole piece 22 is disposed in the center of the magnet 21. The back plate 26, the top plate 28, and the bumper plate 60 may be formed to include a magnetic material having a low magnetic resistance including steel, an alloy, or other magnetic materials.

The back plate 26, the top plate 28, and the bumper plate 60 may be coupled by an adhesive member or mutually coupled by a clamping member including a screw, etc.

The back plate 26 may be provided to be connected to a lower end of the pole piece 22. The pole piece 22 may be formed to be protruded toward a front direction (upper side) in a middle portion of the back plate 26.

The pole piece 22 may be provided to form a path of the magnetic flux generated by the magnet 21.

A magnetic gap S generating a magnetic force may be formed between the top plate 28 and the pole piece 22.

The top plate 28 and the back plate 26 are respectively disposed on an upper side and a lower side of the magnet 21 and provided to support the magnet 21, and it is preferable that the top plate 28 and the back plate 26 are formed with corresponding sizes and shapes.

Meanwhile, a bumper plate 60 may be provided between the back plate 26 and the magnet 21.

The bumper plate 60 may include a first bumper plate 61 and a second bumper plate 62. A hollow may be formed in the center of the first bumper plate 61 and the second bumper plate 62 so that the pole piece 22 may be inserted in the hollow.

It is preferable that the first bumper plate 61 and the second bumper plate 62 are formed flat to be stackable on an upper side and a lower side to each other.

The top plate 28, the magnet 21, the bumper plate 60, and the back plate 26 are sequentially stacked and disposed from an upper end of the pole piece 22.

Meanwhile, in the exemplary embodiments, an example in which the bumper plate 60 includes two bumper plates is shown, but the inventive concept of the present disclosure is not limited thereto. For example, the number of the bumper plate 60 may be two or more. Further, the thickness of the bumper plate 60 of the exemplary embodiment may be set variously according to a design of a designer based on an output of the speaker.

Here, the bumper plate 60 may make the magnetic gap S expandable and enlarge the amplitude of the voice coil 25.

That is, the magnetic gap S may be expanded by the bumper plate 60, and a movable distance of the vibrating voice coil 25 wound around the bobbin 24 may be increased by the expanded magnetic gap S.

The movable distance of the voice coil 25 may be increased by the magnetic gap S being enlarged by the thickness of the bumper plate 60 formed between the back plate 26 and the magnet 21, relative to a conventional magnetic gap formed by a top plate and a back plate.

Meanwhile, the specific structure of the vibration system 1*a* may be the same as that of another exemplary embodiment of the present disclosure, and therefore detailed description therefore will be omitted.

FIGS. 7 to 10 are perspective views illustrating bumper plates according to other exemplary embodiments of the present disclosure.

Figure 7:
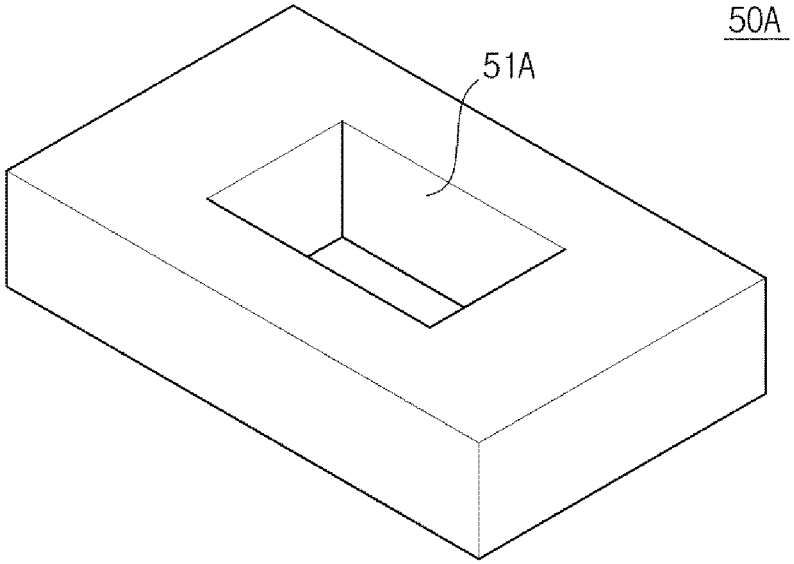
FIGS. 7 to 10 are perspective views illustrating bumper plates according to other exemplary embodiments of the present disclosure.

As shown in FIG. 7, the bumper plate 50A may be formed in a quadrangle shape. A hollow 51A may be included in the center of the bumper plate 50A having the quadrangle shape so that the pole piece 22 may be inserted in the hollow 51A.

Here, in this exemplary embodiment, the hollow 51A is formed in the quadrangle shape.

The quadrangle shaped bumper plate 50A may have a plate shape having a predetermined thickness, and a plurality of stacked bumper plates may also be provided.

Figure 8:
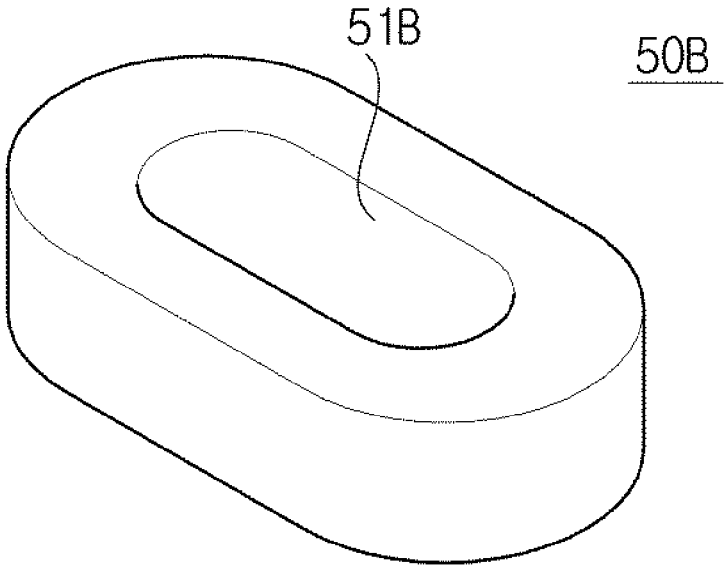

Meanwhile, as shown in FIG. 8, the bumper plate 50B may be formed in an oval shape. A hollow 51B may be included in the center of the bumper plate 50B having the oval shape so that the pole piece 22 may be inserted in the hollow 51B.

Here, in this exemplary embodiment, the hollow 51B is formed in the oval shape.

The oval shaped bumper plate 50B may have a plate shape having a predetermined thickness, and a plurality of stacked bumper plates may also be provided.

Figure 9:
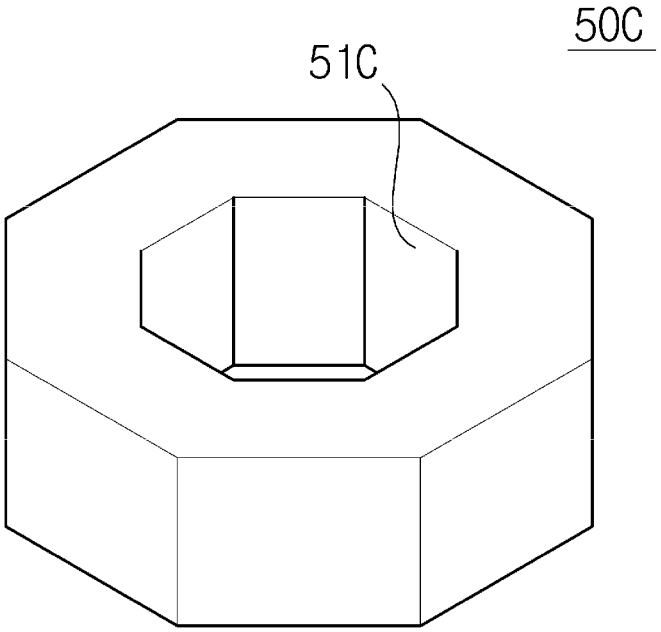

Further, as shown in FIG. 9, the bumper plate 50C may be formed in an octagon shape. A hollow 51C may be included in the center of the bumper plate 50C having the octagon shape so that the pole piece 22 may be inserted in the hollow 51C.

Here, in this exemplary embodiment, the hollow 51C is formed in the octagon shape.

The octagon shaped bumper plate 50C having the octagon shape and a predetermined thickness may have a plate shape, and a plurality of stacked bumper plates may also be provided.

Figure 10:
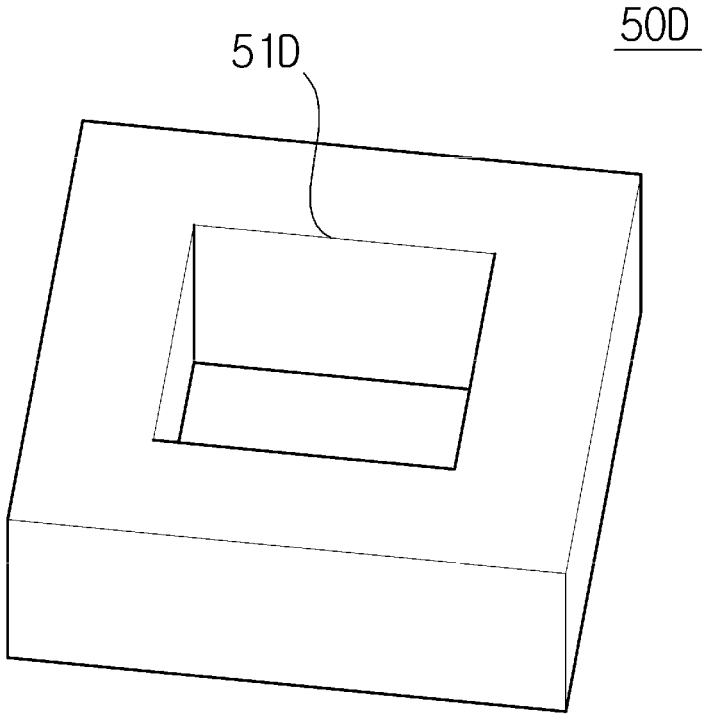

Further, as shown in FIG. 10, the bumper plate 50D may be formed in a diamond shape. A hollow 51D may be included in the center of the bumper plate 50D having the diamond shape so that the pole piece 22 may be inserted in the hollow 51D.

Here, in this exemplary embodiment, the hollow 51D is formed in the diamond shape.

The diamond shaped bumper plate 50D may have a plate shape having a predetermined thickness, and a plurality of stacked bumper plates may be provided.

Meanwhile, the quadrangle shaped bumper plate 50A, the oval shaped bumper plate 50B, the octagon shaped bumper plate 50C, and the diamond shaped bumper plate 50D may be formed with various thicknesses according to the output of the speaker apparatus 1. Further, a design may be variously changed according to the shape of the vibration system 1*a* of the speaker apparatus 1. For example, a bumper plate having an oval shape may be applicable to a speaker apparatus including a vibration plate of a vibration system having the oval shape.

According to exemplary embodiments of the present disclosure, the speaker apparatus can operate in a large amplitude regime, and therefore can provide a plentiful sound output.

Further, the speaker apparatus can generate large amplitude even when the speaker apparatus is fabricated in a small size.

Further, the speaker apparatus does not require an additional processing to be able to operate in a large amplitude regime, and therefore fabrication is easy and cost savings can realized.

Although a few exemplary embodiments of the present disclosure have been shown and described, it would be appreciated by those skilled in the art that changes may be made in these exemplary embodiments without departing from the principles and spirit of the disclosure, the scope of which is defined in the claims and their equivalents.

What is claimed is:

1. A speaker apparatus comprising:

a frame having an upper end flange and a lower end flange;

a magnet configured to generate a magnetic flux;

a pole piece configured to form a path of the magnetic flux generated by the magnet;

a back plate provided at a lower end of the pole piece;

a top plate coupled to the frame and provided such that a magnetic gap is formed between the top plate and the pole piece;

a fixing bump formed on a top surface of the top plate and coupled to and inserted into the lower end flange of the frame;

at least one bumper plate disposed between the magnet and the back plate; and a voice coil disposed in the magnetic gap and provided to vibrate when a current is applied, wherein the at least one bumper plate is provided so that the magnetic gap is expanded to enlarge amplitude of output sound, wherein the at least one bumper plate includes a first flat surface and a second flat surface, a thickness between the first flat surface and the second flat surface being constant, and wherein a moving distance of the voice coil is equal to or greater than an entire thickness of the top plate, the magnet and the at least one bumper plate.

2. The speaker apparatus of claim 1, wherein the magnet includes neodymium.

3. The speaker apparatus of claim 1, wherein the at least one bumper plate is adhered by an adhesive member.

4. The speaker apparatus of claim 1, further comprising:

a diaphragm configured to generate a sound pressure based on a vibration of the voice coil.

5. The speaker apparatus of claim 1, wherein the at least one bumper plate is configured to have one from among a quadrangle shape, a pentagon shape, a cone shape, a ring shape, and a diamond shape.

6. A speaker apparatus comprising:

a frame having an upper end flange and a lower end flange;

a pole piece;

a magnet provided at the pole piece and configured to generate a magnetic flux;

a top plate coupled to the frame and disposed on an upper side of the magnet;

a fixing bump formed on a top surface of the top plate and coupled to and inserted into the lower end flange of the frame;

a voice coil disposed in a magnetic gap and provided to vibrate when a current is applied;

a vibration plate configured to generate a sound pressure based on a vibration of the voice coil;

a back plate provided at a lower end of the pole piece; and at least one bumper plate disposed between the back plate and the magnet, wherein the at least one bumper plate includes a first flat surface and a second flat surface, a thickness between the first flat surface and the second flat surface being constant, and wherein a moving distance of the voice coil is equal to or greater than an entire thickness of the top plate, the magnet and the at least one bumper plate.

7. The speaker apparatus of claim 6, wherein the magnet includes neodymium.

8. The speaker apparatus of claim 6, wherein the at least one bumper plate has one from among a quadrangle shape, a pentagon shape, a cone shape, a ring shape, and a diamond shape.

9. The speaker apparatus of claim 6, wherein an adhesive is provided on an upper surface and a lower surface of the at least one bumper plate.

10. The speaker apparatus of claim 6, wherein the at least one bumper plate is disposed on the back plate.

11. The speaker apparatus of claim 6, wherein the frame has a cone shape in which a diameter increases from a downward direction to a upward direction.

12. The speaker apparatus of claim 1, wherein the back plate supports the magnet.

13. The speaker apparatus of claim 6, wherein the magnetic gap is formed between the top plate and the pole piece.

14. The speaker apparatus of claim 6, wherein the at least one bumper plate is provided such that the magnetic gap is expanded to enlarge an amplitude of the voice coil.

15. The speaker apparatus of claim 1, wherein the top plate and the back plate have corresponding sizes.

16. The speaker apparatus of claim 6, wherein the top plate and the back plate have corresponding sizes.

* * * * *